United States Patent [19]

Hashimoto et al.

[11] Patent Number: 4,741,981

[45] Date of Patent: May 3, 1988

[54] PHOTOSENSITIVE MATERIAL FOR ELECTROPHOTOGRAPHY CONTAINS ORGANIC PHOSPHITE COMPOUNDS

[75] Inventors: Junichiro Hashimoto; Izumi Aiso; Hideki Akiyoshi, all of Numazu, Japan

[73] Assignee: Ricoh Co., Ltd., Tokyo, Japan

[21] Appl. No.: 889,643

[22] Filed: Jul. 24, 1986

[30] Foreign Application Priority Data

| | | | |
|---|---|---|---|
| Jul. 30, 1985 | [JP] | Japan | 60-166861 |
| Dec. 10, 1985 | [JP] | Japan | 60-276046 |
| Jun. 18, 1986 | [JP] | Japan | 61-141887 |

[51] Int. Cl.[4] ..... G03G 5/14

[52] U.S. Cl. ..... 430/58; 430/59; 430/529; 252/400.24

[58] Field of Search ..... 430/57, 58; 252/400.24

[56] References Cited

U.S. PATENT DOCUMENTS

| | | | |
|---|---|---|---|
| 4,299,759 | 11/1981 | Miyata et al. | 524/321 X |
| 4,315,807 | 2/1982 | Felder et al. | 525/375 X |
| 4,454,052 | 6/1984 | Shoji et al. | 252/68 |
| 4,563,408 | 1/1986 | Lin et al. | 430/59 |

*Primary Examiner*—J. David Welsh

*Attorney, Agent, or Firm*—Flynn, Thiel, Boutell & Tanis

[57] ABSTRACT

This invention relates to a layered type photosensitive material for electrophotography, which comprises a charge generating layer and a charge transfer layer on an electroconductive substrate, characterized by containing a trivalent organic phosphite compound as an agent for preventing light-degradation.

18 Claims, 1 Drawing Sheet

PHOTOSENSITIVE MATERIAL FOR ELECTROPHOTOGRAPHY CONTAINS ORGANIC PHOSPHITE COMPOUNDS

BACKGROUND OF THE INVENTION (a) Field of the Invention

This invention relates to a photosensitive material for electrophotography, which contains an organic phosphite compound as an agent for preventing light-degradation.

(b) Description of the Prior Art

In general, Carlson type electrophotographic process comprises the steps of electrifying the surface of photosensitive material for electrophotography in the dark, subjecting the electrified surface to image-exposure to form electrostatic latent image, developing the electrostatic latent image with dry type or wet type toner, transferring the developed toner image on a plain copy paper and fixing the image. The photosensitive material used in this type of electrophotographic process is required to have good electrification properties, high sensitivity, small dark decay, small residual potential after exposure, and stable electrostatic properties during repeated use. There is known an organic type electrophotographic photosensitive material which comprises, on an electroconductive substrate, a charge generating layer containing an organic charge generating material such as azo pigment, perylene pigment or the like as the main component and a charge transfer layer containing a charge transfer material, for example, an electron doner compound such as polyvinyl carbazole (PVK) or an electron acceptor compound such as trinitrofluorenone (TNF) as the main component. These organic photosensitive materials satisfy the above mentioned requirements to some extent, but they have photomemory effect. It is therefore very difficult to produce a stable image of high density because various properties, such as surface potential, rising properties of potential at the initial stage of electrification and dark decay, produced in the steps of electrification and exposure after being irradiated with light of high intensity, largely change (or are lowered) as compared with those before being irradiated with light (this phenomenon is called as "preflashing degradation"). These defects are produced also by light-degradation during practical use (running). As mentioned above, these conventional organic photosensitive materials severely suffer from degradation by light (light-degradation), and therefore they must be handled in the dark, which causes inconvenience. Moreover, there was a problem that the electrophotographic properties of these conventional photosensitive materials deteriorate by repeated use.

On the other hand, under the consideration that these defects are caused by ultra-violet ray or ozone during exposure or electrification, the addition of a benzotriazole type, benzophenone type or other ultra-violet ray absorbers, phenylene diamine type agent for preventing degradation by ozone, phenol type antioxidant, pentavalent organic phosphorous compound type agent for preventing light-degradation and the like has been tried. However, satisfactory results could not be obtained.

SUMMARY OF THE INVENTION

An object of this invention is to provide a photosensitive material for electrophotography, which has excellent properties in view of surface potential at the preflashing, rising properties at the initial stage of electrification and variation of dark decay. That is, an object of this invention is to provide a photosensitive material for electrophotography, the preflashing degradation and light-degradation during running of which are very little.

More concretely, an object of this invention is to provide a layered type photosensitive material for electrophotography, which comprises a charge generating layer and a charge transfer layer on an electroconductive substrate, characterized by containing a trivalent organic phosphite compound as an agent for preventing light-degradation.

DETAILED DESCRIPTION OF THE INVENTION

The photosensitive material for electrophotography in accordance with the present invention is a layered type photosensitive material which comprises a charge generating layer and a charge transfer layer on an electroconductive substrate, characterized by containing a trivalent organic phosphite compound as an agent for preventing light-degradation.

The present invention is more fully illustrated in accordance with the accompanying drawings.

Figure 1:
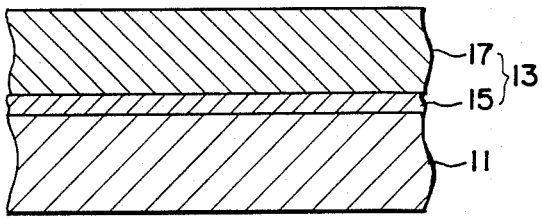
FIGS. 1 and 2 are sectional views illustrating the structure examples of the electrophotographic photosensitive material of the present invention.

FIG. 1 is a sectional view illustrating a structure example of the electrophotographic element of the present invention, which comprises a photosensitive layer 13 formed by providing a charge generating layer 15 on an electroconductive substrate 11 and overlaying a charge transfer layer 17 on the charge generating layer 15.

In this structure, at least one of the charge generating layer 15 and the charge transfer layer 17 contains a trivalent organic phosphorous acid ester compound as an agent for preventing light-degradation.

The trivalent organic phosphorous acid ester compound used in the present invention is expressed by the following general formula (I),

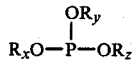

(I)

wherein Rx, Ry and Rz represent hydrogen, or substituted or non-substituted aliphatic or aromatic group, but there is no case that all of Rx, Ry and Rz are hydrogen at the same time.

In case that one or two of Rx, Ry and Rz are hydrogen, this compound displays tautomerism as expressed by the following chemical formulas:

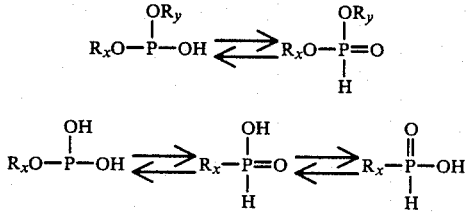

Among these phosphite compounds, preferable compounds have the general formula (I) in which all of Rx, Ry and Rz are an aliphatic group having a carbon number of not less than 4 (typically 4 to 26), more preferably not less than 8 (typically 8 to 26).

Typical examples of the trivalent organic phosphite compound are further expressed by at least one of the following general formulas (II) to (IV),

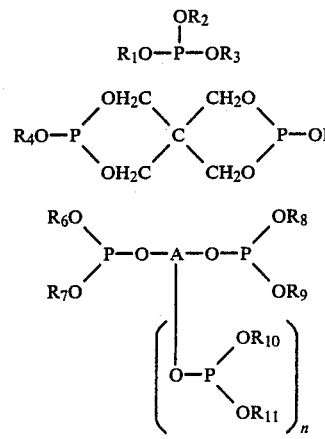

(II)

(III)

(IV)

wherein $R_1$ to $R_{11}$ respectively may be the same or different, and represent hydrogen, a substituted or non-substituted alkyl group, substituted or non-substituted alkenyl group, substituted or non-substituted allyl group, or substituted or non-substituted aryl group such as substituted or non-substituted alkylaryl group, but there is no case that all of $R_1$, $R_2$ and $R_3$ are hydrogen at the same time; A represents a substituted or non-substituted alkylene group, or substituted or non-substituted aromatic group; and n represents an integer of 0 or 1.

In said general formula (II), all of $R_1$, $R_2$ and $R_3$ are preferably an alkyl or alkenyl group having a carbon number of not less than 4 (typically 4 to 26), more preferably not less than 8 (typically 8 to 26).

In said general formula (III), all of $R_4$ and $R_5$ are preferably an alkyl or alkenyl group having a carbon number of not less than 4 (typically 4 to 26), more preferably not less than 8 (typically 8 to 26).

In said general formula (IV), all of $R_6$ to $R_9$ are preferably an alkyl or alkenyl group having a carbon number of not less than 4 (typically 4 to 26), more preferably not less than 8 (typically 8 to 26), and n=0,

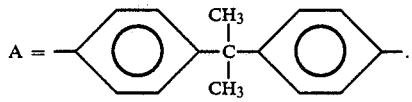

More typical examples of the trivalent organic phosphite compound include trimethyl phosphite, triethyl phosphite, tri-n-butyl phosphite, trioctyl phosphite, tridecyl phosphite, tridodecyl phosphite, tristearyl phosphite, trioleyl phosphite, tris(tridecyl) phosphite, tricetyl phosphite, dilauryl hydrogen phosphite, diphenyl monodecyl phosphite, diphenyl mono(tridecyl) phosphite, tetraphenyl dipropylene glycol diphosphite, 4,4'-butylidene-bis(3-methyl-6-t-phenyl-di-tridecyl) phosphite, distearyl pentaerythritol diphosphite, ditridecyl pentaerythritol diphosphite, dinonylphenyl pentaerythritol diphosphite, diphenyl octyl phosphite, tetra(tridecyl)-4,4'-isopropylidene diphenyl diphosphite, tris(2,4-di-t-butyl phenyl) phosphite, di(2,4-di-t-butyl phenyl) pentaerythritol diphosphite, di(nonyl phenyl) pentaerythritol diphosphite,

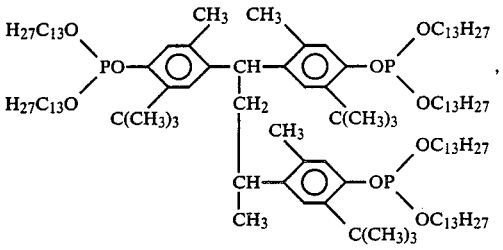

and

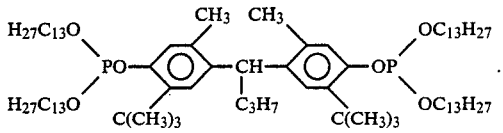

At any event, all of publicly known trivalent organic phosphorous compounds, for example, those disclosed in Japanese Patent Publication Nos. 51-40589; 51-25064; 50-35097; 49-20928; 48-22330; 51-35193; and the like can be used for the purpose of this invention.

The organic phosphite compound as mentioned above can be used alone or in combination.

An amount of the organic phosphite compound added to a charge generating layer 15 may vary depending on a charge generating material and a binder used, but is generally 0.01 to 20% by weight, preferably 0.05 to 5.0% by weight on the basis of the weight of charge generating material.

An amount of the organic phosphite compound added to a charge transfer layer 17 may also vary depending on a charge transfer material and a binder used, but is generally 0.01 to 5.0% by weight, preferably 0.04 to 2.4% by weight on the basis of the weight of charge transfer material.

An charge generating layer 15 contains a charge generating material and a binder, and optionally contains the above mentioned organic phosphite compound also.

Examples of the charge generating material include: CI Pigment Blue 25 (Color Index (CI) 21180), CI Pigment Red 41 (CI 21200), CI Acid Red 52 (CI 45100), CI Basic Red 3 (CI 45210), and the like; azo pigment having carbazole structure (see Japanese Patent Laid Open No. 53-95033), azo pigment having styryl stilbene structure (see Japanese Patent Laid Open No. 53-133229), azo pigment having triphenyl amine structure (see Japanese Patent Laid Open No. 53-132547), azo pigment having dibenzothiophene structure (see Japanese Patent Laid Open No. 54-217287), azo pigment having oxadiazole structure (see Japanese Patent Laid Open No. 54-127427), azo pigment having fluorenone structure (see Japanese Patent Laid Open No. 54-22837), azo pigment having bisstilbene structure (see Japanese Patent Laid Open No. 54-17733), azo pigment having distyryl oxadiazole structure (see Japanese Patent Laid Open No. 54-2129), azo pigment having distyryl carbazole structure (see Japanese Patent Laid Open No. 54-17734), azo pigment having carbazole structure (see Japanese Patent Laid Open No. 57-195767), phthalocyanine pigment such as CI Pigment Blue 16 (CI 74100), indigo pigment such as CI Vat Brown 5 (CI 73410), CI Vat Dye (CI 73030), and the like, perylene pigment such as Algoscarlet B (Bayel AG), and the like.

These charge generating materials are used respectively alone or in combination.

Among these charge generating materials. preferable examples are selected from the group consisting of diazo pigment having fluorenone structure expressed by the following general formula (A) and trisazo pigment having triphenyl amine structure expressed by the following general formula (B):

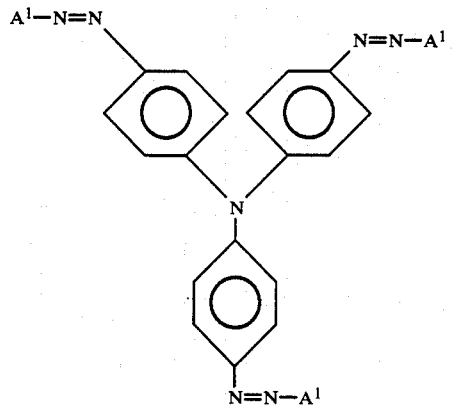

(A)

wherein $A^1$ represents

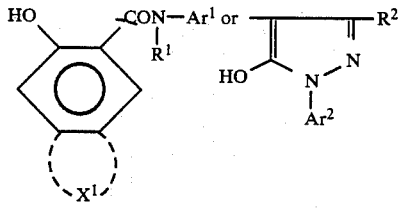

(wherein $X^1$ represents an aromatic ring such as benzene ring and naphthalene ring or their substituted materials, or a heterocyclic ring such as indole ring, carbazole ring and benzofuran ring or their substituted materials;

$Ar^1$ represents an aromatic ring such as benzene ring and naphthalene ring or their substituted materials, or a heterocyclic ring such as dibenzofuran ring or their substituted materials;

$Ar^2$ represents an aromatic ring such as benzene ring and naphthalene ring or their substituted materials;

$R^1$ represents hydrogen, lower alkyl group, phenyl group or their substituted materials; and $R^2$ represents alkyl group, carbamoyl group, carboxyl group or its ester); and

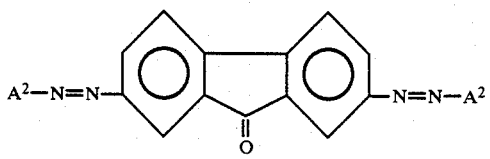

(B)

wherein $A^2$ represents

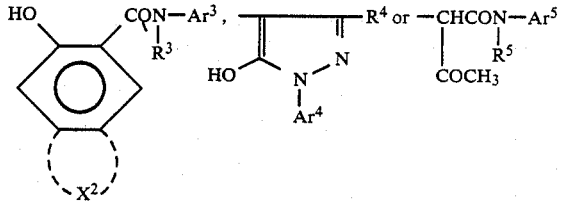

(wherein $X^2$ represents an aromatic ring such as benzene ring and naphthalene ring or their substituted materials, or a heterocyclic ring such as indole ring, carbazole ring and benzofuran ring or their substituted materials;

$Ar^3$ and $Ar^4$ represent an aromatic ring such as benzene ring and naphthalene ring or their substituted materials, or a heterocyclic ring such as dibenzofuran ring or their substituted materials;

$Ar^5$ represents an aromatic ring such as benzene ring and naphthalene ring or their substituted materials;

$R_3$ and $R^5$ represent hydrogen, lower alkyl group, phenyl group or their substituted materials; and $R^4$ represents alkyl group, carbamoyl group, carboxyl group or its ester).

Examples of a substituent group to $X^1$ in the above general formula (A) and $X^2$ in the above general formula (B) include a halogen atom such as chlorine, bromine and the like, alkoxy group, alkyl group, and the like.

Examples of a substituent group to $Ar^1$ in the above general formula (A) and $Ar^3$ and $Ar^4$ in the above general formula (B) include an alkyl group such as methyl, ethyl, propyl, butyl and the like, an alkoxy group such as methoxy, ethoxy, propoxy, butoxy and the like, a halogen atom such as chlorine, bromine and the like, a dialkyl amino group such as dimethyl amino, diethyl amino and the like, a diaralkyl amino group such as dibenzyl amino group and the like, a halomethyl group such as a trifluoromethyl group and the like, nitro group, cyano group, carboxyl group or its ester, hydroxyl group, a sulfonate group such as $—SO_3Na$, and the like.

Examples of a substituent group to $Ar^2$ in the above general formula (A) and $Ar^5$ in the above general formula (B) include an alkyl group such as methyl, ethyl, propyl, butyl and the like, an alkoxy group such as methoxy, ethoxy, propoxy, butoxy and the like, a halogen atom such as chlorine, bromine and the like, a dialkyl amino group such as dimethyl amino, diethyl amino and the like, nitro group, and the like.

Examples of a substituent group to phenyl groups of $R^1$ in the above general formula (A) and $R^3$ and $R^5$ in the above general formula (B) include a halogen atom such as chlorine, bromine and the like.

Concrete examples of the compound expressed by the general formula (A) are disclosed in Japanese Patent Laid Open No. 53-132547.

Concrete examples of the compound expressed by the general formula (B) are disclosed in Japanese Patent Laid Open No. 54-22834.

Examples of a binder used in a charge generating layer include polyvinyl butyral resin, polyvinyl formal resin, polyester resin, polycarbonate resin, polystyrene, polyvinyl acetate, polyamide, polyurethane, various celluloses, and the like.

A charge generating layer can be prepared by dispersing a charge generating material in a solvent, together with a binder (if necessary), and coating the dispersion on a substrate by painting or dipping coating method.

The binder is used in an amount of 5 to 150 parts by weight per 100 parts by weight of charge generating material.

When an agent for preventing light-degradation is not added to a charge generating layer 15, an inorganic photosensitive material such as Se, Se alloy amorphous Si and the like can be added to the charge generating layer and the inorganic photosensitive material can be formed on a substrate by vapour deposition, sputtering, glow discharge or the other method.

An appropriate thickness of a charge generating layer is 0.05 to 20μ, preferably 0.1 to 2.0μ.

A charge transfer layer 17 contains a charge transfer material and a binder.

A charge transfer material may be any of an electron donor material and an electron acceptor material, but is preferably an electron donor material, the examples of which include an α-substituted stilbene compound as expressed by the following general formula (C) and a hydrazone compound as expressed by the following general formula (D).

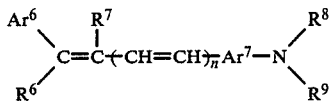

(C)

(wherein $R^6$ represents a substituted or non-substituted alkyl group, or a substituted or non-substituted aryl group;

$R^7$, $R^8$ and $R^9$ represent hydrogen, a substituted or non-substituted alkyl, or a substituted or non-substituted aryl group;

$Ar^6$ represents a substituted or non-substituted aryl group;

$Ar^7$ represents a substituted or non-substituted arylene group;

$Ar^6$ and $R^6$ may form a ring together; and n is an integer of 0 or 1).

Examples of an alkyl group of $R^6$, $R^7$, $R^8$ and $R^9$ in the above general formula (C) include methyl, ethyl, propyl, butyl, pentyl, hexyl and the like.

Examples of a substituent group to a substituted alkyl group of $R^6$, $R^7$, $R^8$ and $R^9$ in the above general formula (C) include an alkoxy group such as methoxy, ethoxy, propoxy, butoxy, pentyloxy and the like, an aryloxy group such as phenoxy, tolyloxy, naphthyloxy and the like, an aryl group such as phenyl, naphthyl and the like, an alkyl amino group such as dimethyl amino, diethyl amino, dipropyl amino, N-methyl-N-ethyl amino and the like, an aryl amino group such as N-phenyl amino, N,N-diphenyl amino and the like, hydroxy group, amino group, and the like. The number of a substituent on an alkyl group may be one or more, and they may be the same or different when two or more substituents are present. Examples of the substituted alkyl group include alkoxy alkyl, aryloxy alkyl, amino alkyl, hydroxy alkyl, aralkyl, alkylamino alkyl, arylamino alkyl and the like.

Examples of an aryl group of $Ar^6$, $R^6$, $R^7$, $R^8$ and $R^9$ include mono- or polycarbocyclic, or mono- or polyheterocyclic aromatic residue groups, more concretely phenyl, naphthyl, anthryl, thienyl, pyridyl, furyl, carbazolyl, styryl and the like.

Examples of a substituent group to a substituted aryl group of $Ar^6$, $R^6$, $R^7$, $R^8$ and $R^9$ in the above general formula (C) include an alkylamino group such as dimethyl amino, diethyl amino, dipropyl amino and the like, an alkoxy group such as methoxy, ethoxy, propoxy, butoxy and the like, an aryloxy group such as phenoxy, tolyloxy, naphthyloxy and the like, diphenyl amino group, an alkyl group such as methyl, ethyl, propyl, butyl and the like, an amino group such as ditolyl amino group, hydroxy group, phenoxy group, a halogen atom such as chlorine, bromine and the like, cyano group, nitro group, an alkylthio group such as ethylthio group, and an arylthio group such as phenylthio, npahthylthio and the like. The number of a substituent on an aryl group may be one or more, and they may be the same or different when two or more substituents are present. Examples of the substituted aryl group include dialkylamino aryl, alkoxy aryl, aryloxy aryl, alkyl aryl, diarylamino aryl, amino aryl, hydroxy aryl, phenyl aryl, haloaryl, cyano aryl, nitroaryl, thioalkoxy aryl, thioaryloxy aryl and the like.

Examples of an arylene group of $Ar^7$ include the above mentioned mono- or polycarbocyclic, or mono- or polyheterocyclic aromatic residue groups. Examples of a substituent to a substituted arylene group include the above mentioned substituents enumerated with regard to the above substituted aryl group. The number of a substituent on an aryl group may be one or more, and they may be the same or different when two or more substituents are present.

Examples of a ring formed by the combination of $Ar^6$ and $R^6$ include fluorenyl, cyclopentadienyl, cyclohexadienyl, cyclohexenyl, cyclopentenyl and the like. These rings may also have a substituent as mentioned above.

More concrete examples of α-substituted stilbene compound include as follows:

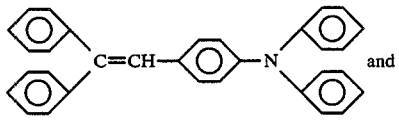

and

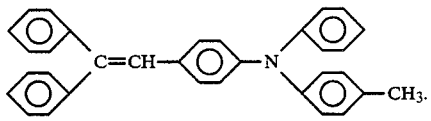

Other examples of α-substituted stilbene compound are fully disclosed in Japanese Patent Laid Open No. 60-98437.

Another preferable example of a charge transfer material is hydrazone compound having the following general formula (D), and this compound achieves an excellent effect when used in combination with the agent for preventing light-degradation of the present invention.

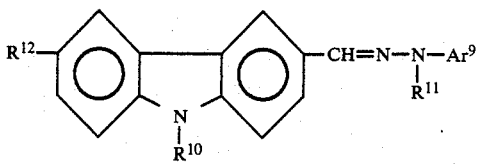

(D)

(wherein $R^{10}$ represents a substituted or non-substituted alkyl group such as methyl, ethyl, propyl, 2-hydroxyethyl, 2-chloroethyl or benzyl group, or a substituted or non-substituted phenyl group;

$R^{11}$ represents methyl, ethyl or benzyl group, or a substituted or non-substituted phenyl group; and $R^{12}$ represents hydrogen, chlorine, bromine, an alkyl group having a carbon number of 1 to 4, an alkoxy group having a carbon number of 1 to 4, a dialkyl amino group or nitro group.)

More concrete examples of the hydrazone compound include as follows:

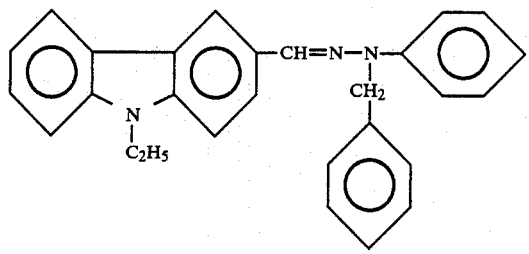

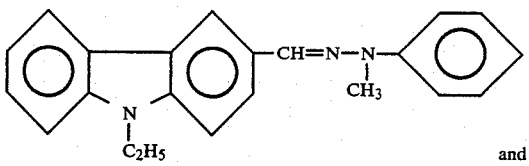

and

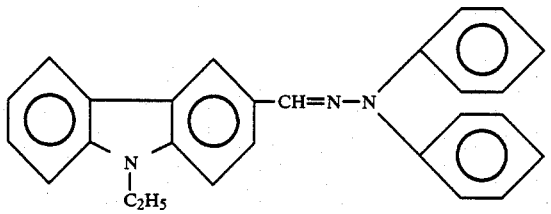

Other examples are fully disclosed in Japanese Patent Laid Open No. 55-46760.

Examples of other electron donor compounds include a compound having at least one of an alkyl group such as methyl, alkoxy group, amino group, imino group and imide group, or a compound having, on the main chain or the side chain, a polycycloaromatic residue group such as anthracene, pyrene, phenanthrene, coronene and the like, or a nitrogen-containing cyclic residue group such as indole, carbazole, oxazole, isooxazole, thiazole, imidazole, pyrazole, oxadiazole, thiadiazole, triazole and the like.

More concrete examples of a low molecular electron donor compound include hexamethylene diamine, N-(4-amino butyl)cadaverine, as-didodecylhydrazine, p-toluidine, 4-amino-o-xylene, N,N'-diphenyl-1,2-diaminoethane, o-, m- or p-ditolylamine, triphenylamine, diphenylmethane, triphenylmethane, durene, 2-bromo-3,7-dimethylnaphthalene, 2,3,5-trimethylnaphthalene, N'-(3-bromophenyl)-N-(β-naphthyl)urea, N-methyl-N-(α-naphthyl)urea, N,N'-diethyl-N-(α-naphthyl)urea, 2,6-dimethylanthracene, anthracene, 2-phenylanthracene, 9,10-diphenylanthracene, 9,9'-bianthranyl, 2-dimethylaminoanthracene, phenanthrene, 9-aminophenanthrene, 3,6-dimethylphenanthrene, 5,7-dibromo-2-phenylindole, 2,3-dimethylindoline, 3-indolylmethylamine, carbazole, 2-methylcarbazole, N-ethylcarbazole, 9-phenylcarbazole, 1,1'-dicarbazole, 3-(p-methoxyphenyl)oxazolidine, 3,4,5-trimethylisooxazole, 2-anilino-4,5-diphenylthiazole, 2,4,5-trinitrophenylimidazole, 4-amino-3,5-dimethyl-1-phenylpyrazole, 2,5-diphenyl-1,3,4-oxadiazole, 1,3,5-triphenyl-1,2,4-triazole, 1-amino-5-phenyltetrazole, bis-diethylaminophenyl-1,3,6-oxadiazole and the like.

More concrete examples of a high molecular electron donor compound include poly-N-vinylcarbazole and its derivatives (for example, those having carbazole structure having a substituent of halogen such as chlorine, bromine and the like, methyl, amino, and the like), polyvinylpyrene, polyvinylanthracene, pyreneformaldehyde polycondensate and its derivatives (for example those having pyrene structure having a substituent of halogen such as bromine, nitro, and the like.

On the other hand, examples of an electron acceptor compound include carboxylic anhydride, compounds having an electron acceptive structure such as orth- or paraquinoid and the like, cycloaliphatic, aromatic or heterocyclic compounds having an electron acceptive substituent such as nitro group, cyano group and the like. More concrete examples of them include maleic anhydride, phthalic anhydride, tetrachlorophthalic anhydride, tetrabromophthalic anhydride, naphthalic anhydride, pyromellitic anhydride, chloro-p-benzoquinone, 2,5-dichlorobenzoquinone, 2,6-dichlorobenzoquinone, 5,8-dichloronaphthoquinone, o-chloroanil, o-bromoanil, p-chloroanil, p-bromoanil, p-iodoanil, tetracyanoquinodimethane, 5,6-quinoline-di-one, cumarin-2,2-di-one, oxyindirubin, oxyindigo, 1,2-dinitroethane, 2,2-dinitropropane, 2-nitro-nitrosopropane, iminodiacetonitrile, succinonitrile, tetracyanoethylene, 1,1,3,3-tetracyanopropenide, o-, m- or p-dinitrobenzene, 1,2,3-trinitrobenzene, 1,2,4-trinitrobenzene, 1,3,5-trinitrobenzene, dinitrobenzene, 2,4-dinitroacetophenone, 2,4-dinitrotoluene, 1,3,5-trinitrobenzophenone, 1,2,3-trinitroanisole, α-,β-dinitronaphthalene, 1,4,5,8-tetranitronaphthalene, 3,4,5-trinitro-1,2-dimethylbenzene, 3-nitroso-2-nitrotoluene, 2-nitroso-3,5-dinitrotoluene, o-, m- or p-nitro-nitrosobenzene, phthalonitrile, terephthalonitrile, isophthalonitrile, benzoyl cyanide, bromobenzyl cyanide, quinoline cyanide, o-xylylene cyanide, o-, m- or p-nitrobenzyl cyanide, 3,5-dinitropyridine, 3-nitro-2-pyridine, 3,4-dicyanopyridine, α-, β- or γ-cyanopyridine, 4,6-dinitroquinone, 4-nitroxanthone, 9,10-dinitroanthracene, 1-nitroanthracene, 2-nitrophenanthraquinone, 2,5-dinitrofluorenone, 2,6-dinitrofluorenone, 3,6-dinitrofluorenone, 2,7-dinitrofluorenone, 2,4,7-trinitrofluorenone, 2,4,5,7-tetranitrofluorenone, 3,6-dinitrofluorenone mandenonitrile, 3-nitrofluorenone mandenonitrile, tetracyanopyrene, and the like.

Examples of a binder used in a charge transfer layer include thermoplastic or thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymr, polyvinyl acetate, polyvinylidene chloride, polyallylate resin, phenoxy resin, polycarbonate, cellulose acetate, ethyl cellulose, polyvinyl butyral, polyvinyl formal, polyvinyl toluene, poly-N-vinyl carbazole, acrylic resin, silicone resin, epoxy resin, melamine resin, urethane resin, phenol resin alkyd resin, and the like. A binder is used in a weight ratio (binder/charge transfer material) of 10/1~1/10, preferably ½~2/1. A charge transfer layer may further contain publicly known plasticizers, leveling agents, and other additives. A charge transfer layer generally has a thickness of 2~200μ, preferably 5~30μ.

Examples of an electroconductive substrate include a plastic film or cylinder vapor-deposited with aluminum, nickel, chromium, tin oxide, indium oxide or the like (examples of the plastic used for this purpose include polyester, polypropylene, cellulose acetate and the like); paper or plastic film laminated with an electroconductive thin film such as aluminum foil; and metal plate or cylinder made of aluminum, nickel, stainless steel, iron or the like.

Figure 2:
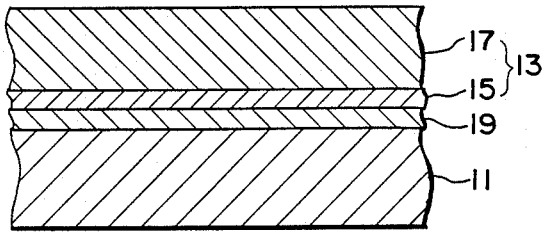

FIG. 2 is a sectional view illustrating another structure of the electrophotographic photosensitive material of the present invention, wherein an underlayer 19, a charge generating layer 15 and a charge transfer layer 17 are deposited in order on an electroconductive substrate 11.

The organic phosphite compound (agent for preventing light-degradation) of the present invention is added to at least one of an underlayer 19, a charge generating layer 15 and a charge transfer layer 17.

An underlayer 19 is provided for improving electrification properties, adhesive properties and other properties, and for preventing the occurrence of moire. An underlayer comprises a resin such as polyamide, polyvinyl acetate, polyurethane, alcohol-soluble nylon, polyvinyl butyral, water-soluble polyvinyl butyral or the like as the main component, and aluminum oxide, tin oxide, electroconductive carbon, zinc oxide or other additives may be dispersed therein.

A suitable thickness of an underlayer 19 is 0.01 to 10 μm, preferably 0.01 to 5.0 μm.

As mentioned above, according to the present invention, a photosensitive material of high quality having excellent properties in view of surface potential at the preflashing, rising properties at the initial stage of electrification and variation of dark decay, can be obtained by adding the organic phosphite compound to any of underlayer, charge generating layer and charge transfer layer. That is, the preflashing degradation and light-degradation during running can be remarkably prevented by the addition of the organic phosphite. This photosensitive material of the present invenion is very useful as an organic type photosensitive material using an organic charge generating material and an organic charge transfer material.

The present invention is further illustrated by the following examples, but should not be limited thereto. All the parts and percentage are expressed by weight.

EXAMPLE 1

A mixture for forming a charge generating layer comprising 1.7 parts of a disazo pigment having the following chemical structure,

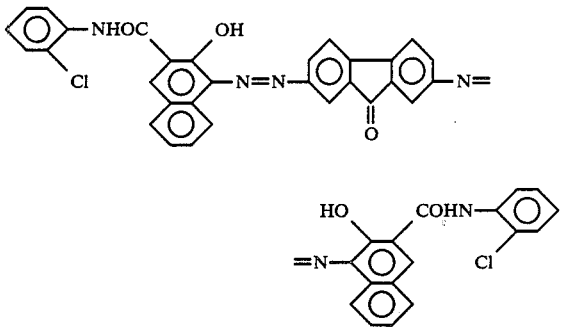

13.6 parts of a 5% tetrahydrofuran solution of polyvinyl butyral ("XYHL" manufactured by Union Carbide Plastic Co.) and 44.2 parts of tetrahydrofuran was dispersed in a ball mill for 48 hours. 22.3 g of tetrahydrofuran and 37.2 g of ethyl cellosolve were then added to the resultant mixture, and the mixture was further dispersed for 1 hour. The dispersion thus obtained was diluted with tetrahydrofuran in such a manner as to make a weight ratio of tetrahydrofuran/ethyl cellosolve to 4/6 and a solid content concentration of 1%. The dispersion was then coated on an aluminum vapor-deposited polyester film by a doctor blade, and the coated film was dried at 80° C. for 5 minutes to form a charge generating layer having a thickness of about 0.8 μm.

A mixture for forming a charge transfer layer comprising the following components was coated on the above prepared charge generating layer by a doctor blade.

| | |
|---|---|
| 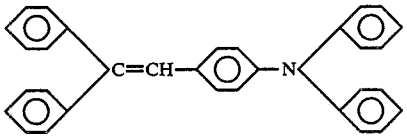 (α-substituted stilbene compound) | 18 parts |
| polycarbonate ("Panlite K1300" manufactured by Teijin Kasei Co.) | 20 parts |
| silicone oil ("KF 50" manufactured by Shinetsu Kaguku Co.) | 0.004 part |
| trioleyl phosphite ("P-390" manufactured by Tokyo Kasei Co.) | 0.038 part |
| methylene chloride | 152 parts |

The above coated film was then dried at 80° C. for 2 minutes and further at 130° C. for 5 minutes to prepare a charge transfer layer having a thickness of about 19 μm.

COMPARATIVE EXAMPLE 1

A comparative electrophotographic element was prepared in the same manner as in Example 1, except that trioleyl phosphite was removed from the mixture for forming a charge transfer layer.

EXAMPLE 2

A mixture for forming a charge generating layer comprising 2.5 parts of a trisazo pigment having the following chemical structure,

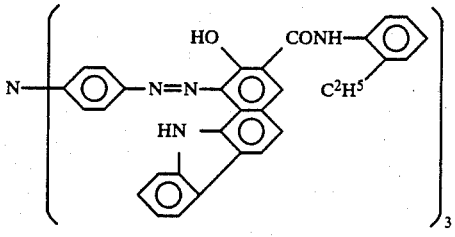

10 parts of a 5% cyclohexanone solution of polyvinyl formal ("Denkaformal #20" manufactured by Denki Kagaku Kogyo Co.) and 47.5 parts of cyclohexanone was dispersed in a ball mill for 48 hours. 90 parts of cyclohexanone was then added to the resultant mixture, and the the mixture was further dispersed for 1 hour. The dispersion thus obtained was diluted with cyclohexanone in such a manner as to make a solid content concentration of 1%. The dispersion was then coated on an aluminum vapor-deposited polyester film by a doctor blade, and the coated film was dried at 80° C. for 5 minutes to form a charge generating layer having a thickness of about 0.4 μm.

An electrophotographic element was prepared in the same manner as in the above Example 1 by coating the above prepared charge generating layer with a mixture for forming a charge transfer layer prepared in the same manner as in Example 1, except that tristearyl phosphite ("JP-318E" manufactured by Johoku Kagaku Kogyo Co.) was used in place of trioleyl phosphite and that the compound having the following chemical structure was used as an α-substituted stilbene compound.

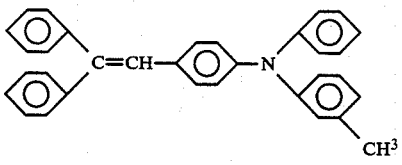

COMPARATIVE EXAMPLE 2

A comparative electrophotographic element was prepared in the same manner as in Example 2, except that tristearyl phosphite was removed from the mixture for forming a charge transfer layer.

The four kinds of electrophotographic elements thus prepared were tested by an electrostatic copying paper ester (SP428 Type manufactured by Kawaguchi Denki Works), and electrophotographic properties were measured under the following conditions (measured by Dynamic Mode). Firstly, the elements were electrified by corona discharge of −6 KV for 20 seconds. Surface potentials $V_1$ (volt) and Vs (volt) were measured respectively at one second after the electrification and at 20 seconds after the electrification. Thereafter, these elements were left to stand in the dark for 20 seconds to measure the surface potential Vo (volt) at that time, thus measuring a dark decary ratio Vo/Vs. The elements were then exposed to radiation of a white color tungsten light of 4.5 Lux to measure an exposure amount, E1/10 (Lux-sec) required to reduce the surface potential to 1/10 of Vo as an initial property. This value (E1/10) was evaluated as a sensitivity.

The elements were then exposed to radiation of a day-light fluorescent lamp for 30 minutes, and they were thereafter left to stand in the dark for 30 seconds. Various properties after degradation by light were measured in the same manner as in the above measurement of the initial properties.

The results are shown in the following Table 1. The value of "degradation rate" in the Table 1 is expressed by (Potential after Light-degradation)/(Initial Potential).

TABLE 1

| | | $V_1$(volt) | Vs(volt) | Vo(volt) | Vo/Vs ratio | $E_{1/10}$ Lux · sec |
|---|---|---|---|---|---|---|
| Example 1 | Initial Value | 512 | 1306 | 1176 | 0.90 | 2.2 |
| | Value after Degradation by Light | 398 | 1296 | 1110 | 0.86 | 2.1 |
| | Degradation Rate | 0.78 | 0.99 | 0.94 | — | — |
| Comparative Example 1 | Initial Value | 458 | 1314 | 1147 | 0.86 | 2.4 |
| | Value after Degradation by Light | 62 | 1198 | 914 | 0.76 | 1.8 |
| | Degradation Rate | 0.14 | 0.91 | 0.78 | — | — |
| Example 2 | Initial Value | 478 | 1150 | 846 | 0.74 | 1.7 |
| | Value after Degradation by Light | 262 | 1086 | 628 | 0.58 | 1.4 |
| | Degradation Rate | 0.55 | 0.94 | 0.74 | — | — |
| Comparative Example 2 | Initial Value | 444 | 1124 | 778 | 0.69 | 1.6 |
| | Value after Degradation by Light | 160 | 1012 | 478 | 0.47 | 1.3 |
| | Degradation Rate | 0.36 | 0.90 | 0.61 | — | — |

EXAMPLES 3 TO 11

Electrophotographic elements were prepared in the same manner as in Example 1, except that the following organic phosphite compounds as listed in the following Table 2 were respectively used for forming charge transfer layers. The initial properties and light-degradation properties were respectively measured in the same manner as in Example 1 and the results thereof are shown in the following Table 2.

TABLE 2

| Example | | | $V_1$(volt) | Vs(volt) | Vo(volt) | Vo/Vs ratio | $E_{1/10}$ Lux · sec |
|---|---|---|---|---|---|---|---|
| 3 | triethyl phosphite | Initial Value | 486 | 1362 | 1214 | 0.89 | 2.5 |
| | | Value after Degra- | 140 | 1276 | 1004 | 0.79 | 2.1 |

TABLE 2-continued

| Example | | | $V_1$(volt) | Vs(volt) | Vo(volt) | Vo/Vs ratio | $E_{1/10}$ Lux · sec |
|---|---|---|---|---|---|---|---|
| | | dation by Light Degradation Rate | 0.29 | 0.94 | 0.83 | — | — |
| 4 | tributyl phosphite | Initial Value | 524 | 1328 | 1186 | 0.89 | 2.4 |
| | | Value after Degradation by Light | 232 | 1276 | 1038 | 0.81 | 2.1 |
| | | Degradation Rate | 0.44 | 0.96 | 0.88 | — | — |
| 5 | trioctyl phosphite | Initial Value | 550 | 1384 | 1230 | 0.89 | 2.4 |
| | | Value after Degradation by Light | 260 | 1300 | 1050 | 0.81 | 2.0 |
| | | Degradation Rate | 0.47 | 0.94 | 0.85 | — | — |
| 6 | triisodecyl phosphite | Initial Value | 532 | 1332 | 1190 | 0.89 | 2.3 |
| | | Value after Degradation by Light | 236 | 1268 | 1034 | 0.82 | 2.1 |
| | | Degradation Rate | 0.44 | 0.95 | 0.87 | — | — |
| 7 | tridodecyl phosphite | Initial Value | 528 | 1294 | 1156 | 0.89 | 2.3 |
| | | Value after Degradation by Light | 416 | 1286 | 1088 | 0.82 | 2.1 |
| | | Degradation Rate | 0.79 | 0.99 | 0.94 | — | — |
| 8 | tetra-(tridecyl)-4, 4'-isopropylidene diphenyl diphosphite | Initial Value | 464 | 1312 | 1172 | 0.89 | 2.4 |
| | | Value after Degradation by Light | 396 | 1300 | 1090 | 0.85 | 2.0 |
| | | Degradation Rate | 0.86 | 0.99 | 0.93 | — | — |
| 9 | 4,4'-butylidene-bis (3-methyl-6-t-butyl phenyl ditridecyl) phosphite | Initial Value | 510 | 1316 | 1184 | 0.89 | 2.5 |
| | | Value after Degradation by Light | 154 | 1250 | 992 | 0.84 | 2.0 |
| | | Degradation Rate | 0.30 | 0.95 | 0.84 | — | — |
| 10 | diphenyl mono(tridecyl) phosphite | Initial Value | 476 | 1356 | 1218 | 0.90 | 2.5 |
| | | Value after Degradation by Light | 134 | 1278 | 994 | 0.78 | 2.0 |
| | | Degradation Rate | 0.28 | 0.94 | 0.82 | — | — |
| 11 | distearyl pentaerythritol phosphite | Initial Value | 516 | 1350 | 1216 | 0.90 | 2.3 |
| | | Value after Degradation by Light | 426 | 1358 | 1156 | 0.85 | 2.1 |
| | | Degradation Rate | 0.83 | 1.00 | 0.95 | — | — |

COMPARATIVE EXAMPLES 3 TO 8

Comparative electrophotographic elements were prepared in the same manner as in Example 1, except that trioleyl phosphite contained in the charge transfer layer was replaced respectively by the compounds as listed in the following Table 3. The initial properties and light-degradation properties were respectively measured in the same manner as in Example 1 and the results thereof are shown in the following Table 3.

TABLE 3

| Comparative Example | | | $V_1$(volt) | Vs(volt) | Vo(volt) | Vo/Vs ratio | $E_{1/10}$ Lux · sec |
|---|---|---|---|---|---|---|---|
| 3 | 2-(2'-hydroxy-5'-methyl phenyl) benzotriazole (ultraviolet ray absorber) | Initial Value | 574 | 1384 | 1222 | 0.88 | 2.4 |
| | | Value after Degradation by Light | 140 | 1308 | 1002 | 0.77 | 1.9 |
| | | Degradation Rate | 0.24 | 0.95 | 0.82 | — | — |
| 4 | 2-hydroxy-4-methoxy benzophenone (ultraviolet ray absorber) | Initial Value | 518 | 1384 | 1232 | 0.89 | 2.4 |
| | | Value after Degradation by Light | 120 | 1306 | 998 | 0.76 | 1.9 |
| | | Degradation Rate | 0.23 | 0.94 | 0.81 | — | — |
| 5 | N—phenyl-N'—isopropyl-p-phenylene diamene (agent for preventing degradation by ozone) | Initial Value | 714 | 1534 | 1138 | 0.74 | un-measurable |
| | | Value after Degradation by Light | — | — | — | — | — |
| | | Degradation Rate | — | — | — | — | — |
| 6 | 2,6-di-t-butyl-p-cresol (antioxidant) | Initial Value | 536 | 1350 | 1198 | 0.89 | 2.4 |
| | | Value after Degradation by Light | 66 | 1252 | 940 | 0.75 | 1.9 |
| | | Degradation Rate | 0.12 | 0.93 | 0.78 | — | — |
| 7 | diphenyl phosphate (pentavalent organophosphorus compound) | Initial Value | 474 | 1368 | 1192 | 0.87 | 2.2 |
| | | Value after Degradation by Light | 24 | 1008 | 484 | 0.48 | 1.1 |
| | | Degradation Rate | 0.05 | 0.74 | 0.41 | — | — |
| 8 | di-n-butyl phosphate (pentavalent organophosphorus compound) | Initial Value | 508 | 1318 | 1132 | 0.86 | 2.0 |
| | | Value after Degradation by Light | 20 | 598 | 28 | 0.05 | 4.8 |
| | | Degradation Rate | 0.04 | 0.45 | 0.02 | — | — |

EXAMPLE 12

An electrophotographic element was prepared by coating a mixture for forming a charge transfer layer comprising the following components on the charge generating layer as prepared in Example 1 by a doctor blade.

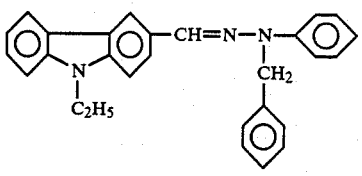

| | |
|---|---|
| (hydrazone compound) | 18 parts |
| polycarbonate ("Panlite K1300" manufactured by Teijin Kasei Co.) | 20 parts |
| silicone oil ("KF 50" manufactured by Shinetsu Kagaku Co.) | 0.004 part |
| tristearyl phosphite ("JP-318E" manufactured by Johoku Kagaku Kogyo Co.) | 0.038 part |
| tetrahydrofuran | 152 parts |

The above coated film was then dried at 80° C. for 2 minutes and further at 120° C. for 5 minutes to prepare a charge transfer layer having a thickness of about 19 μm.

COMPARATIVE EXAMPLE 9

A comparative electrophotographic element was prepared in the same manner as in Example 12, except that tristearyl phosphite was removed from the mixture for forming a charge transfer layer.

EXAMPLE 13

An electrophotographic element was prepared by coating a mixture for forming a charge transfer layer comprising the following components on the charge generating layer as prepared in Example 2 by a doctor blade.

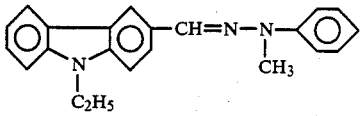

| | |
|---|---|
| (hydrazone compound) | 18 parts |
| polyacrylate ("Upylon U-1060" manufactured by Unichika Co.) | 20 parts |
| silicone oil (the same used in Example 12) | 0.006 part |
| trioleyl phosphite ("P-390" manufactured by Tokyo Kagaku Kogyo Co.) | 0.038 part |
| tetrahydrofuran | 152 parts |

The above coated film was then dried in the same manner as in Example 12 to prepare a charge transfer layer having a thickness of about 20 μm.

COMPARATIVE EXAMPLE 10

A comparative electrophotographic element was prepared in the same manner as in Example 13, except that trioleyl phosphite was removed from the mixture for forming a charge transfer layer.

Various properties with regard to the electrophotographic elements of Examples 12 and 13, and Comparative Examples 9 and 10 were measured in the same manner as mentioned above, and the results are shown in the following Table 4.

TABLE 4

| | | $V_1$(volt) | Vs(volt) | Vo(volt) | Vo/Vs ratio | $E_{1/10}$ Lux · sec |
|---|---|---|---|---|---|---|
| Example 12 | Initial Value | 528 | 1268 | 1062 | 0.84 | 1.8 |
| | Value after Degradation by Light | 320 | 1202 | 850 | 0.71 | 1.6 |
| | Degradation Rate | 0.61 | 0.95 | 0.80 | — | — |
| Comparative Example 9 | Initial Value | 568 | 1362 | 1142 | 0.84 | 1.8 |
| | Value after Degradation by Light | 148 | 1132 | 620 | 0.55 | 3.6 |
| | Degradation Rate | 0.26 | 0.83 | 0.55 | — | — |
| Example 13 | Initial Value | 518 | 1086 | 686 | 0.63 | 1.4 |
| | Value after Degradation by Light | 395 | 1010 | 502 | 0.50 | 1.1 |
| | Degradation Rate | 0.76 | 0.93 | 0.73 | — | — |
| Comparative Example 10 | Initial Value | 518 | 1104 | 698 | 0.63 | 1.4 |
| | Value after Degradation by Light | 228 | 994 | 410 | 0.41 | 1.1 |
| | Degradation Rate | 0.44 | 0.90 | 0.59 | — | — |

EXAMPLES 14 TO 18

Electrophotographic elements were prepared in the same manner as in Example 12, except that tristearyl phosphite compounds contained in the charge transfer layer was replaced respectively by the organic phosphite compounds as listed in the following Table 5. The initial properties and light-degradation properties were respectively measured in the same manner as above and the results thereof are shown in the following Table 5.

TABLE 5

| Example | | | $V_1$(volt) | Vs(volt) | Vo(volt) | Vo/Vs ratio | $E_{1/10}$ Lux · sec |
|---|---|---|---|---|---|---|---|
| 14 | triethyl phosphite | Initial Value | 502 | 1240 | 1030 | 0.83 | 1.8 |
| | | Value after Degradation by Light | 146 | 1090 | 698 | 0.64 | 1.5 |
| | | Degradation Rate | 0.29 | 0.88 | 0.68 | — | — |
| 15 | tributyl phosphite | Initial Value | 532 | 1288 | 1082 | 0.84 | 1.9 |
| | | Value after Degra- | 202 | 1198 | 778 | 0.65 | 1.5 |

TABLE 5-continued

| Example | | | $V_1$(volt) | Vs(volt) | Vo(volt) | Vo/Vs ratio | $E_{1/10}$ Lux · sec |
|---|---|---|---|---|---|---|---|
| | | dation by Light Degradation Rate | 0.38 | 0.93 | 0.72 | — | — |
| 16 | tridodecyl phosphite | Initial Value | 512 | 1252 | 1052 | 0.84 | 1.8 |
| | | Value after Degradation by Light | 266 | 1176 | 812 | 0.69 | 1.6 |
| | | Degradation Rate | 0.52 | 0.94 | 0.77 | — | — |
| 17 | tetra-(tridecyl)-4,4'-isopropylidene diphenyl phosphite | Initial Value | 526 | 1260 | 1046 | 0.83 | 1.8 |
| | | Value after Degradation by Light | 306 | 1184 | 828 | 0.70 | 1.6 |
| | | Degradation Rate | 0.58 | 0.94 | 0.79 | — | — |
| 18 | distearyl pentaerythritol phosphite | Initial Value | 510 | 1248 | 1048 | 0.84 | 1.8 |
| | | Value after Degradation by Light | 306 | 1186 | 830 | 0.70 | 1.6 |
| | | Degradation Rate | 0.60 | 0.95 | 0.79 | — | — |

EXAMPLE 19

A mixture for forming a charge generating layer comprising 1.7 parts of disazo pigment having the following chemical structure,

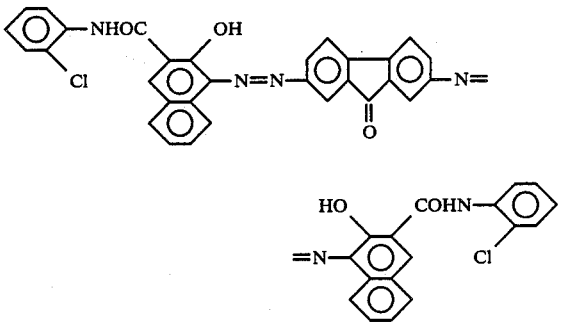

13.6 parts of a 5% cyclohexanone solution of polyvinyl butyral ("XYHL" manufactured by UCC Co.) and 44.2 parts of cyclohexanone was dispersed in a ball mill for 48 hours. A 1% solution for forming a charge generating layer was prepared by adding a solution of 0.11 part of tristearyl phosphite in 11.9 parts of cyclohexanone to the above prepared dispersion.

The solution thus prepared was then coated on an aluminum vapor-deposited polyester film by a doctor blade, and the coated film was dried at 95° C. for 5 minutes to form a charge generating layer having a thickness of 0.5 μm.

A mixture for forming a charge transfer layer comprising the following components was coated on the above prepared charge generating layer by a doctor blade.

| | |
|---|---|
| 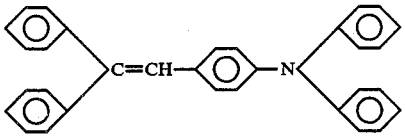 | 18 parts |
| polycarbonate ("Panlite K1300" manufactured by Teijin Kasei Co.) | 20 parts |
| silicone oil ("KF 50" manufactured by Shinetsu Kagaku Co.) | 0.004 part |
| tetrahydrofuran | 152 parts |

The above coated film was then dried at 80° C. for 2 minutes and further at 130° C. for 5 minutes to prepare a charge transfer layer having a thickness of about 19 μm, thus producing an electrophotographic element.

COMPARATIVE EXAMPLE 11

A comparative electrophotographic element was prepared in the same manner as in Example 19, except that tristearyl phosphite was removed from the mixture for forming a charge generating layer.

EXAMPLE 20

A mixture for forming a charge generating layer comprising 2.5 parts of trisazo pigment having the following chemical structure.

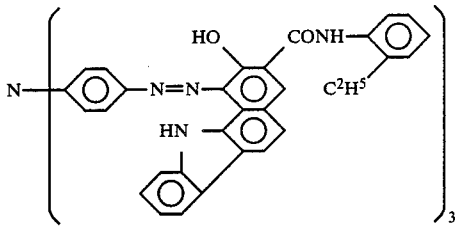

10 parts of a 5% cyclohexanone solution of polyvinyl butyral ("XYHL" manufactured by UCC Co.) and 47.5 parts of cyclohexanone was dispersed in a ball mill for 48 hours. 90 parts of cyclohexanone and 0.12 part of trioleyl phosphite were then added to the resultant mixture, and the mixture was further dispersed for 2 hours. The dispersion thus obtained was diluted with cyclohexanone in such a manner as to make a solid content concentration of 1%. The dispersion was then coated on an aluminum plate (#1050) having a thickness of 0.3 μm by dipping, and the coated film was dried at 110° C. for 10 minutes to form a charge generating layer having a thickness of about 0.4 μm.

A mixture for forming a charge transfer layer comprising the following components was coated on the above prepared charge generating layer by dipping.

| | |
|---|---|
| 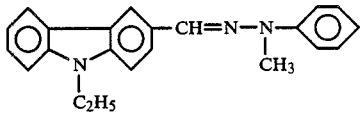 | 18 parts |
| polycarbonate ("Panlite K1300" manufactured by Teijin Kasei Co.) | 20 parts |
| silicone oil ("KF 50" manufactured by Shinetsu Kagaku Co.) | 0.004 part |

-continued

| | |
|---|---|
| methylene chloride | 173 parts |

The above coated film was then dried to form a charge transfer layer having a thickness of about 20 μm, thus producing an electrophotographic element.

COMPARATIVE EXAMPLE 12

A comparative electrophotographic element was prepared in the same manner as in Example 20, except that trioleyl phosphite was removed from the mixture for forming a charge generating layer.

Various properties with regard to the electrophotographic elements of Examples 19 and 20, and Comparative Examples 11 and 12 were measured in the same manner as mentioned above, and the results are shown in the following Table 6.

TABLE 6

| | | $V_1$(volt) | Vs(volt) | Vo(volt) | Vo/Vs ratio | $E_{1/10}$ Lux · sec |
|---|---|---|---|---|---|---|
| Example 19 | Initial Value | 578 | 1394 | 1234 | 0.89 | 2.2 |
| | Value after Degradation by Light | 392 | 1360 | 1124 | 0.83 | 1.9 |
| | Degradation Rate | 0.68 | 0.98 | 0.91 | — | — |
| Comparative Example 11 | Initial Value | 458 | 1314 | 1174 | 0.89 | 2.4 |
| | Value after Degradation by Light | 62 | 1198 | 914 | 0.76 | 1.8 |
| | Degradation Rate | 0.14 | 0.91 | 0.78 | — | — |
| Example 20 | Initial Value | 480 | 1050 | 693 | 0.66 | 1.4 |
| | Value after Degradation by Light | 336 | 977 | 520 | 0.53 | 1.0 |
| | Degradation Rate | 0.70 | 0.93 | 0.75 | — | — |
| Comparative Example 12 | Initial Value | 468 | 989 | 583 | 0.59 | 1.4 |
| | Value after Degradation by Light | 160 | 840 | 319 | 0.38 | 0.9 |
| | Degradation Rate | 0.34 | 0.85 | 0.55 | — | — |

What we claim is:

1. A multilayer photosensitive material for electrophotography, which comprises an electroconductive substrate, a charge generating layer and a charge transfer layer on said electroconductive substrate, said photosensitive material containing an effective amount of an organic phosphite compound for preventing light degradation of the surface potential charging properties of said photosensitive material, said organic phosphite compound being selected from the group consisting of compounds having the formulas (II), (III) and (IV),

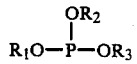

(II)

wherein $R_1$, $R_2$ and $R_3$ represent hydrogen, alkyl having up to 26 carbon atoms, alkenyl having up to 26 carbon atoms, substituted phenyl having an alkyl or alkenyl substituent or non-substituted phenyl, provided that at least one of $R_1$, $R_2$ and $R_3$ is said alkyl or alkenyl;

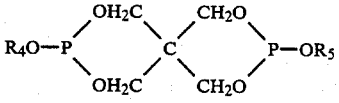

(III)

wherein $R_4$ and $R_5$ represent alkyl having up to 26 carbon atoms, alkenyl having up to 26 carbon atoms, substituted phenyl having an alkyl or alkenyl substituent or non-substituted phenyl;

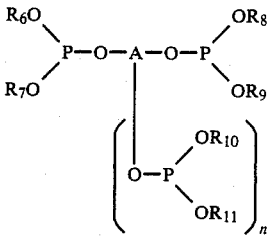

(IV)

wherein $R_6$, $R_7$, $R_8$, $R_9$, $R_{10}$ and $R_{11}$ represent alkyl having up to 26 carbon atoms, alkenyl having up to 26 carbon atoms, a substituted phenyl having an alkyl or alkenyl substituent or non-substituted phenyl; "n" represents an integer of 0 or 1; and A represents

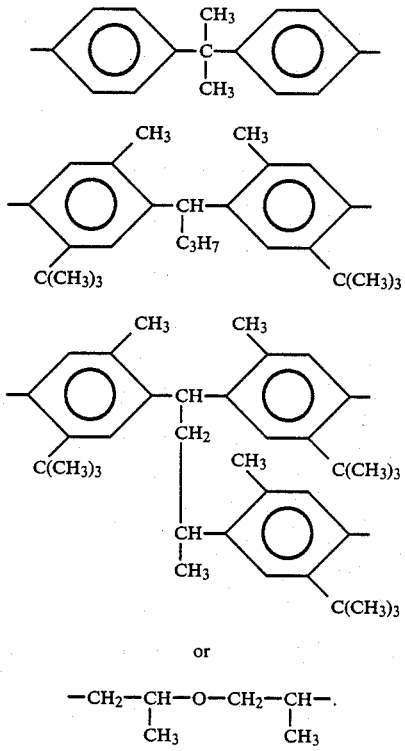

or

2. The photosensitive material as claimed in claim 1, wherein said organic phosphite compound for preventing light-degradation is contained in said charge generating layer.

3. The photosensitive material as claimed in claim 2, wherein said organic phosphite compound for preventing light-degradation is contained in an amount of 0.01–20% by weight on the basis of the weight of charge generating material.

4. The photosensitive material as claimed in claim 1, wherein said organic phosphite compound for preventing light-degradation is contained in said charge transfer layer.

5. The photosensitive material as claimed in claim 4, wherein said organic phosphite compound for preventing light-degradation is contained in an amount of 0.01–5.0% by weight on the basis of the weight of charge transfer material.

6. The photosensitive material as claimed in claim 1, wherein an underlayer is provided between said substrate and said charge generating layer.

7. The photosensitive material as claimed in claim 6, wherein said organic phosphite compound for preventing light-degradation is contained in said underlayer.

8. The photosensitive material as claimed in claim 1, wherein said organic phosphite compound is a compound having the formula (II) and all of $R_1$, $R_2$ and $R_3$ are alkyl or alkenyl having 4 to 26 carbon atoms.

9. The photosensitive material as claimed in claim 1, wherein said organic phosphite compound is a compound having the formula (III) and both of $R_4$ and $R_5$ are alkyl or alkenyl having 4 to 26 carbon atoms.

10. The photosensitive material as claimed in claim 1, wherein said organic phosphite compound is a compound having the formula (IV) and all of $R_6$ to $R_9$ are alkyl or alkenyl having 4 to 26 carbon atoms, n=0, and

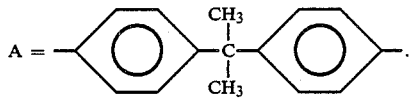

11. The photosensitive material as claimed in claim 1, wherein said trivalent organic phosphite compound is at least one selected from the group consisting of trimethyl phosphite, triethyl phosphite, tri-n-butyl phosphite, trioctyl phosphite, tridecyl phosphite, tridodecyl phosphite, tristearyl phosphite, trioleyl phosphite, tris(-tridecyl)phosphite, tricetyl phosphite, dilauryl hydrogen phosphite, diphenyl monodecyl phosphite, diphenyl mono(tridecyl)phosphite, tetraphenyl dipropylene glycol diphosphite, 4,4'-butylidene-bis(3-methyl-6-t-phenyl-ditridecyl)phosphite, distearyl pentaerythritol diphosphite, ditridecyl pentaerythritol diphosphite, dinonylphenyl pentaerythritol diphosphite, diphenyl octyl phosphite, tetra(tridecyl)-4,4'-isopropylidene diphenyl diphosphite, tris(2,4-di-t-butyl phenyl)phosphite, di(2,4-di-t-butyl phenyl)pentaerythritol diphosphite, di(nonyl phenyl)pentaerythritol diphosphite,

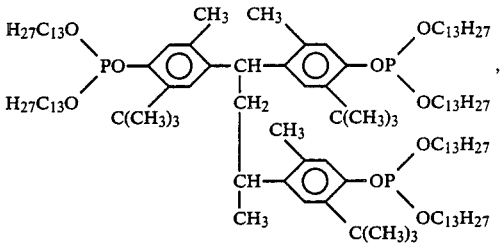

and

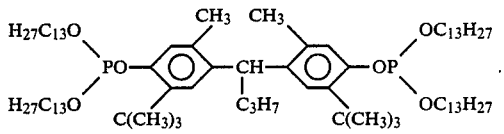

12. The photosensitive material as claimed in claim 1, wherein said charge generating layer contains at least one pigment selected from the group consisting of disazo pigments having fluorenone structure as expressed by the following general formula (A) and trisazo pigments having triphenyl amine structure as expressed by the following general formula (B) as a charge generating material;

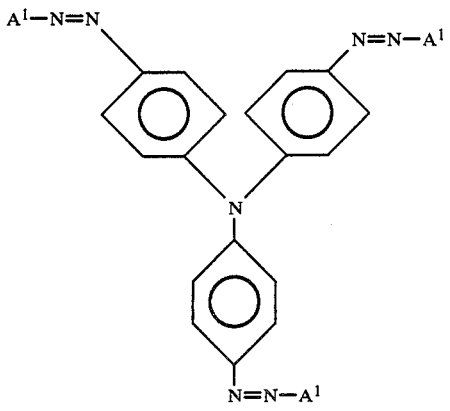

(A)

wherein $A^1$ represents

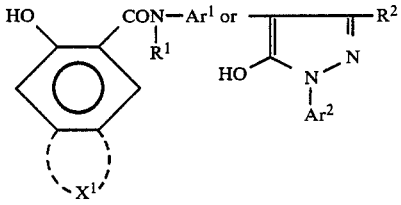

(wherein $X^1$ represents an aromatic ring such as benzene ring and naphthalene ring or their substituted materials, or a heterocyclic ring such as indole ring, carbazole ring and benzofuran ring or their substituted materials;

$Ar^1$ represents an aromatic ring such as benzene ring and naphthalene ring or their substituted materials, or a heterocyclic ring such as dibenzofuran ring or their substituted materials;

$Ar^2$ represents an aromatic ring such as benzene ring and naphthalene ring or their substituted materials;

$R^1$ represents hydrogen, lower alkyl group, phenyl group or their substituted materials; and $R^2$ represents alkyl group, carbamoyl group, carboxyl group or its ester); and

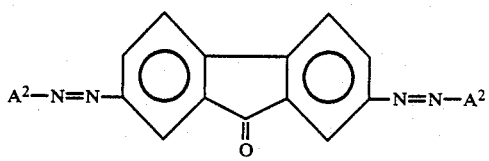

(B)

wherein $A^2$ represents

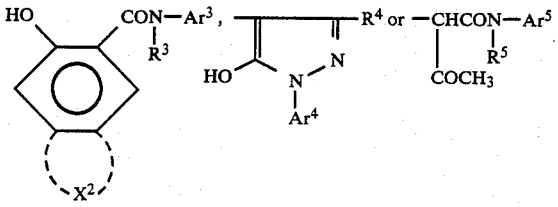

(wherein $X^2$ represents an aromatic ring such as benzene ring and naphthalene ring or their substituted materials, or a heterocyclic ring such as indole ring, carbazole ring and benzofuran ring or their substituted materials;

$Ar^3$ and $Ar^4$ represent an aromatic ring such as benzene ring and naphthalene ring or their substituted materials, or a heterocyclic ring such as dibenzofuran ring or their substituted materials;

$Ar^5$ represents an aromatic ring such as benzene ring and naphthalene ring or their substituted materials;

$R^3$ and $R^5$ represent hydrogen, lower alkyl group, phenyl group or their substituted materials; and $R^4$ represents alkyl group, carbamoyl group, carboxyl group or its ester).

13. The photosensitive material as claimed in claim 1, wherein said charge transfer layer contains at least one selected from the group consisting of α-substituted stilbene compound as expressed by the following general formula (C) and hydrazone compound as expressed by the following general formula (D) as a charge transfer material;

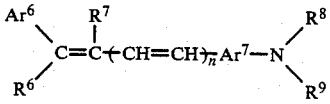

(C)

(wherein $R^6$ represents a substituted or non-substituted alkyl group, or a substituted or non-substituted aryl group;

$R^7$, $R^8$ and $R^9$ represent hydrogen, a substituted or non-substituted alkyl, or a substituted or non-substituted aryl group;

$Ar^6$ represents a substituted or non-substituted aryl group;

$Ar^7$ represents a substituted or non-substituted arylene group;

$Ar^6$ and $R^6$ may form a ring togather; and n is an integer of 0 or 1); and

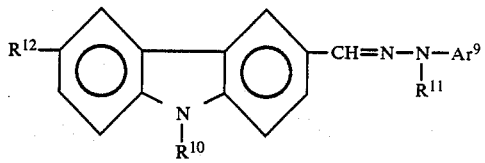

(D)

(wherein $R^{10}$ represents a substituted or non-substituted alkyl group such as methyl, ethyl, propyl, 2-hydroxyethyl, 2-chloroethyl or benzyl group, or a substituted or non-substituted phenyl group;

$R^{11}$ represents methyl, ethyl or benzyl group, or a substituted or non-substituted phenyl group; and $R^{12}$ represents hydrogen, chlorine, bromine, an alkyl group having a carbon number of 1 to 4, an alkoxy group having a carbon number of 1 to 4, a dialkyl amino group or nitro group).

14. The photosensitive material as claimed in claim 11, wherein said organic phosphite compound is tristearyl phosphite.

15. The phosphite material as claimed in claim 11, wherein said organic phosphite compound is trioleyl phosphite.

16. The photosensitive material as claimed in claim 11, wherein said organic phosphite compound is tetra-(tridecyl)-4,4'-isopropylidene diphenyl diphosphite.

17. The photosensitive material as claimed in claim 11, wherein said organic phosphite compound is distearyl pentaerythritol phosphite.

18. A multilayer photosensitive material for electrophotography, which comprises an electroconductive substrate, a charge generating layer and a charge transfer layer on said electroconductive substrate, said photosensitive material containing an effective amount of an organic phosphite compound for preventing light degradation of the surface potential charging properties of said photosensitive material, said organic phosphite compound being selected from the group consisting of compounds having the formulas (II), (III) and (IV),

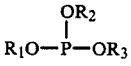

(II)

wherein $R_1$, $R_2$ and $R_3$ represent hydrogen, alkyl having 4 to 26 carbon atoms or alkenyl having 4 to 26 carbon atoms, provided that at least one of $R_1$, $R_2$ and $R_3$ is said alkyl or alkenyl;

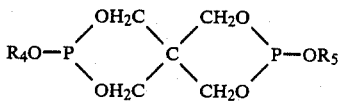

(III)

wherein $R_4$ and $R_5$ represent an alkyl group having 4 to 26 carbon atoms or alkenyl having 4 to 26 carbon atoms;

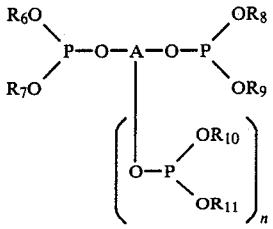
(IV)
wherein $R_6$, $R_7$, $R_8$, $R_9$, $R_{10}$ and $R_{11}$ represent alkyl having 4 to 26 carbon atoms or alkenyl having 4 to 26 carbon atoms; "n" represents an integer of 0 or 1; and A represents
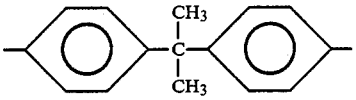
-continued
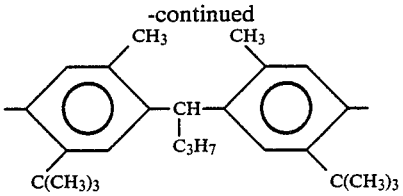
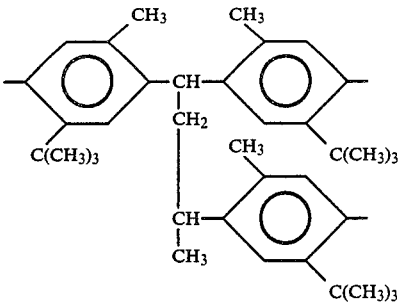
or
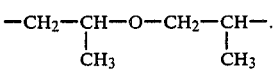
* * * * *